US009724591B2

(12) United States Patent
Slaughter

(10) Patent No.: US 9,724,591 B2
(45) Date of Patent: Aug. 8, 2017

(54) BINDING CLEANER FOR NORDIC SKI BOOTS

(71) Applicant: Jacob Slaughter, Hanover, NH (US)

(72) Inventor: Jacob Slaughter, Hanover, NH (US)

( * ) Notice: Subject to any disclaimer, the term of this patent is extended or adjusted under 35 U.S.C. 154(b) by 0 days.

(21) Appl. No.: 15/148,513

(22) Filed: May 6, 2016

(65) Prior Publication Data

US 2016/0317901 A1 Nov. 3, 2016

Related U.S. Application Data

(63) Continuation-in-part of application No. 14/885,100, filed on Oct. 16, 2015, now Pat. No. 9,333,414.

(60) Provisional application No. 62/155,951, filed on May 1, 2015.

(51) Int. Cl.
*A63C 5/06* (2006.01)

(52) U.S. Cl.
CPC ..... *A63C 5/061* (2013.01)

(58) Field of Classification Search
CPC ..... A63C 5/061; A63C 11/22
See application file for complete search history.

(56) References Cited

U.S. PATENT DOCUMENTS

| | | | | |
|---|---|---|---|---|
| 3,826,518 | A | 7/1974 | Hennig | |
| 3,976,303 | A | 8/1976 | Lillibridge et al. | |
| 3,992,037 | A | 11/1976 | Frechin | |
| 4,049,291 | A * | 9/1977 | Nunan | A63C 9/20 280/614 |
| 4,221,393 | A | 9/1980 | Donahue | |
| 4,573,710 | A | 3/1986 | Ford | |
| D305,270 | S | 12/1989 | Swanson et al. | |
| 4,949,996 | A | 8/1990 | McNally | |
| 5,816,590 | A | 10/1998 | Fey et al. | |
| 5,992,872 | A | 11/1999 | Proctor | |
| 2008/0079238 | A1 * | 4/2008 | Geisler | A63C 5/061 280/610 |

FOREIGN PATENT DOCUMENTS

| | | | |
|---|---|---|---|
| CH | 637841 | A5 | 8/1983 |
| DE | 2648415 | A1 | 4/1978 |
| FR | 2263008 | | 4/1976 |
| FR | 2285909 | | 4/1976 |
| NO | 20120124 | A1 | 8/2013 |
| WO | 9804181 | | 2/1998 |

OTHER PUBLICATIONS

Related U.S. Appl. No. 14/885,100, entitled Binding Cleaner for Nordic Ski Boots.

Notice of Allowance dated Feb. 2, 2016, in related U.S. Appl. No. 14/885,100, entitled "Binding Cleaner for Nordic Ski Boots."

* cited by examiner

*Primary Examiner* — John Walters
*Assistant Examiner* — James Triggs
(74) *Attorney, Agent, or Firm* — Downs Rachlin Martin PLLC

(57) ABSTRACT

Systems, methods, and apparatuses for cleaning recesses in ski boots and installing such apparatuses on various surfaces are disclosed. A user may insert a portion of the apparatus that projects from the surface on which it is installed into a gap between a steel rod in their ski boot designed for use with a ski binding and the sole of the ski boot in order to clear the recess in which the steel rod is disposed.

20 Claims, 4 Drawing Sheets

BINDING CLEANER FOR NORDIC SKI BOOTS

RELATED APPLICATION DATA

This application is a continuation-in-part of U.S. patent application Ser. No. 14/885,100, filed on Oct. 16, 2015, and titled "BINDING CLEANER FOR NORDIC SKI BOOTS", now allowed, which claims the benefit of priority of U.S. Provisional Patent Application Ser. No. 62/155,951, filed on May 1, 2015, and titled "BINDING CLEANER FOR NORDIC SKI BOOTS".

FIELD OF THE INVENTION

The present invention generally relates to the field of accessories for recreational equipment. In particular, the present invention is directed to a binding cleaner for Nordic ski boots.

BACKGROUND

Various bindings for Nordic (i.e., cross-country) skiing have been developed, such as the Salomon Nordic System (or "SNS") and New Nordic Norm system (or "NNN"). These bindings typically include at least one groove designed to accept and releasably engage a steel rod disposed in a recess formed in the sole of a compatible ski boot adjacent the toe portion. By arranging a ski boot such that the steel rod rests within the groove of a compatible binding on a ski and operating a lever on the binding, the front portion of the ski boot can be releasably pivotally attached to the ski, which is useful for Nordic skiing. However, the recess in the ski boot in which the steel rod is disposed can become packed with ice and snow when the boot is worn in snowy environments while not attached to a ski, making it difficult or impossible to place the rod in the groove of the binding and/or to operate the lever on the binding that causes the binding to engage the rod.

SUMMARY OF THE DISCLOSURE

In one implementation, the present invention comprises an apparatus designed and configured to fixedly project from a surface at an angle, wherein the apparatus is sized and shaped such that it can be inserted in a recess in a ski boot having a steel rod for interfacing with a binding on a ski such that the apparatus can extend between the steel rod and at least a portion of the sole of the ski boot. In other implementations, the present invention comprises a system including a ski boot, ski and binding cleaner element projecting from the ski.

In another implementation, the present invention comprises a system for dislodging material trapped in the binding receiving channel of Nordic ski boots, the channel having a width and including a binding securing rod in a front portion defining a rod opening with a height between the rod and boot sole, the system comprising a cleaning element including a base portion configured to be mounted to an upper ski surface, and a projecting portion projecting from the base portion, wherein: the projecting portion is configured and dimensioned to project at a fixed, acute angle from the upper ski surface when the base portion is mounted thereon; the projecting portion has a width less than the binding receiving channel width as to be insertable into and freely moveable through the channel for dislodging of material trapped therein; and the projecting portion has a thickness less than the rod opening height so as to be insertable therethrough for dislodging material trapped in the rod opening.

In yet another implementation, the present invention comprises a method for dislodging material trapped in the binding receiving channel of Nordic ski boots, wherein the channel has a width and includes a binding securing rod extending across a front portion of the channel defining a rod opening with a height between the rod and boot sole, the method comprising: placing the ski boot, while on a wearer's foot, over a cleaning element mounted on a surface of a ski including a binding to which the boot is to be attached; lowering the boot onto the cleaning element with the cleaning element received in the binding receiving channel; and moving the boot forward at least one time with the cleaning element received in the binding receiving channel to dislodge material trapped in the channel.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Aspects of the present invention include systems, methods, and apparatuses for cleaning recesses in ski boots, and particularly for dislodging material, such as ice or snow, trapped in the binding receiving channel of Nordic ski boots. Although a particular apparatus is primarily discussed herein, those of ordinary skill in the art will, after reading this disclosure in its entirety, understand that various modifications can be made and methods and systems can be developed. For example, except as otherwise noted, dimensions may be modified without departing from the scope of the present invention. Further, methods and systems can be implemented and are within the scope of the present invention. For example, methods of producing the apparatus described, methods of attaching the apparatus or obvious variants of the apparatus to various surfaces, and systems including the apparatus or obvious variants of the apparatus can be implemented using the teachings of the present disclosure.

Figure 1A:
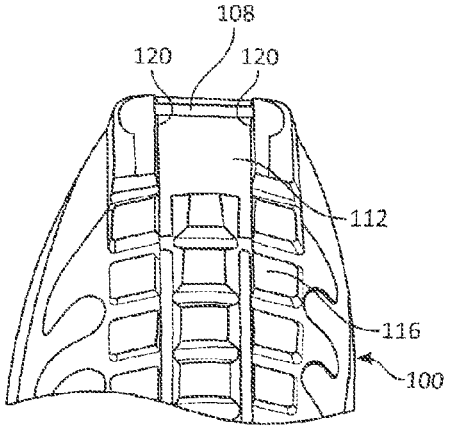
FIG. 1A (Prior Art)
FIGS. 1A and 1B illustrate lower surfaces of two ski boots that may be used in a system according to the present invention.
Figure 1B:
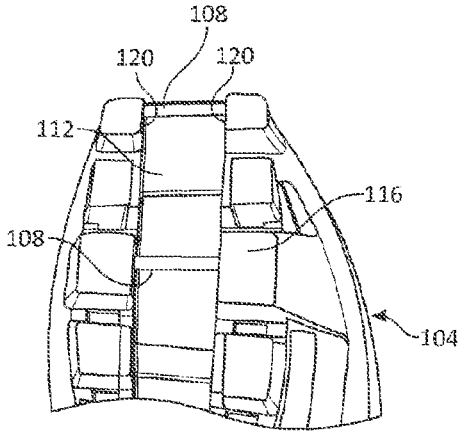
FIG. 1B (Prior Art)

In order to address the problems of the prior art, a system, apparatus and method have been developed by the present inventor in which a cleaning element is designed and configured to fixedly project from a surface at an angle. The cleaning element is sized and shaped such that it can be inserted in a recess or channel in the sole of a ski boot having a steel rod for interfacing with a binding on a ski such that said cleaning element can extend into a recess in the sole of a ski boot and between the steel rod and at least an adjacent portion of the sole of the ski boot. FIGS. 1A and 1B illustrate examples of such ski boots: one NNN boot 100 and one SNS boot 104. As shown therein, steel rods 108 and recesses 112 are located in the soles 116 of the two ski boots 100, 104. An apparatus made in accordance with the present disclosure will fit between steel rods 108 and an adjacent portion of sole 116 of ski boots 100, 104, and will also fit within recess 112 between sidewalls 120 defining the recess. In some embodiments, width of recess 112 between sidewalls 120 is approximately 30 mm (e.g., NNN boots), and in other embodiments the width between the sidewalls is approximately 35 mm (e.g., SNS boots).

Figure 2A:
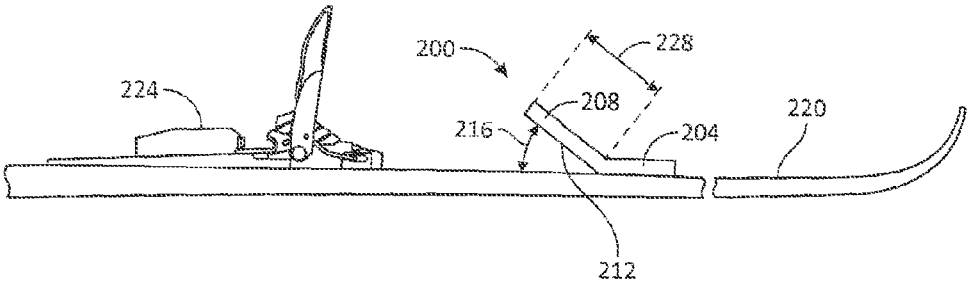
FIGS. 2A, 2B, and 2C illustrate various embodiments of an apparatus made in accordance with the teachings of the present invention.
Figure 2B:
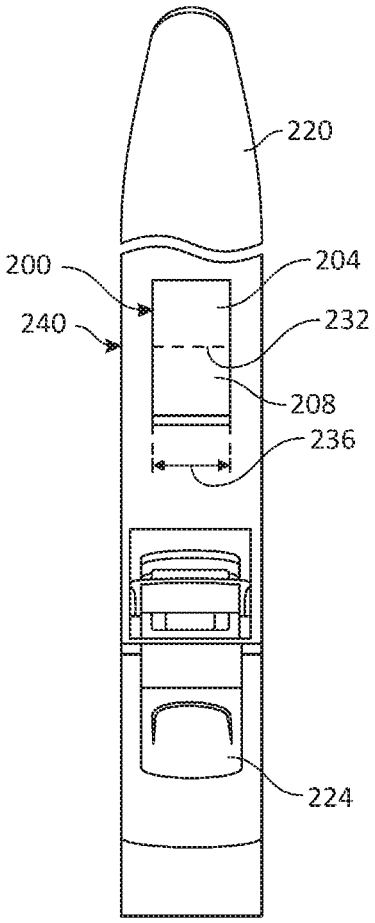
Figure 4A:
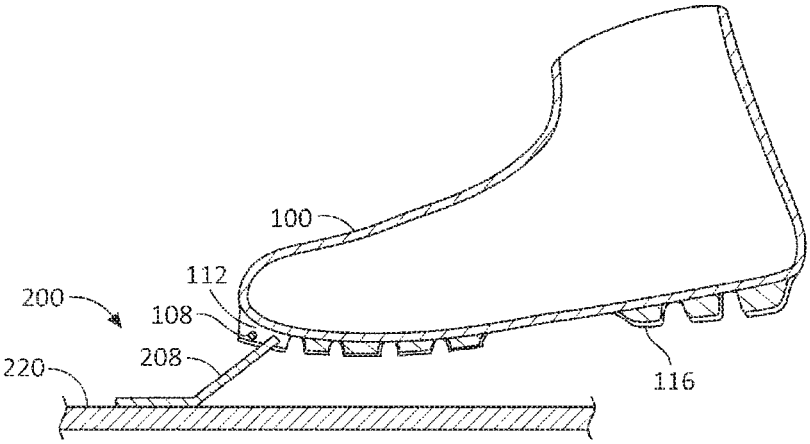
FIGS. 4A and 4B illustrate a method of using an apparatus according to embodiments of the invention for cleaning a ski boot binding receiving channel.
Figure 4B:
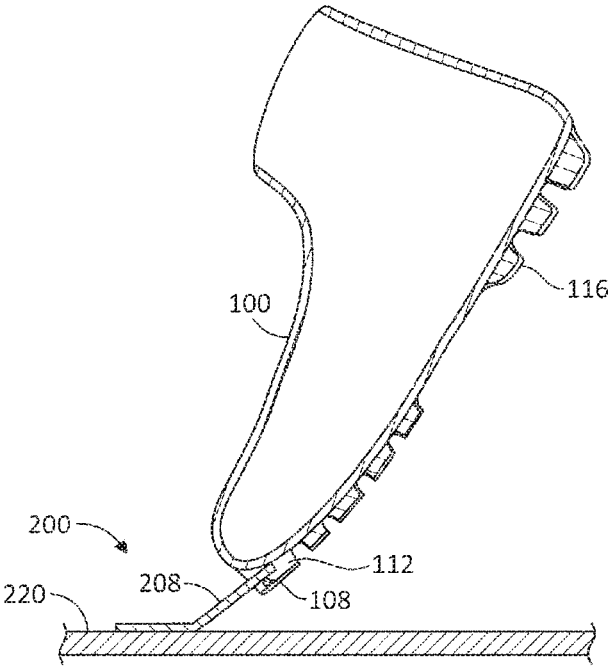

Turning now to FIGS. 2A and 2B, a cleaning element 200 made in accordance with an embodiment of the present invention is shown including a base portion 204 and an upwardly projecting portion 208 having a bottom surface 212. The latter portion is inclined to form an angle 216 with respect to a surface 220 on which base portion 204 is mounted. Surface 220 may be positioned on an outer-most portion of a ski, a ski pole, or a ski boot, among others. In one embodiment, angle 216 is about 40 degrees, but it may be larger or smaller; for example, the angle may be between thirty-five and forty-five degrees or even twenty-five and fifty-five degrees. Advantageously, by setting angle 216 to an acute angle and orienting the cleaning element such that projecting portion 208 projects towards a binding 224 as shown in FIGS. 2A and 2B, a user may utilize the cleaning element by inserting the cleaning element into their ski boot (as shown in FIGS. 4A and 4B) stably and comfortably. Notably, although projecting portion 208 is shown in FIG. 2A as forming an obtuse angle with base portion 204, in some embodiments, the projecting portion may form an acute angle with the base portion. In some embodiments, projecting portion 208 may project from a separate structure and/or cleaning element 200 may not include a distinct base portion. Projecting portion 208 has a length 228 that, in one embodiment, is about 32 mm. Length 228 may be longer or shorter provided that cleaning element 200 can be inserted between steel rods 108 and at least a portion of the ski boot sole 116 adjacent the rod; in some embodiments, the cleaning element may extend at least to the center of the diameter of the furthest steel rod in a ski boot from the toe. For example, the length may be as short as 25 mm or even 12 mm and may be as long as 76-100 mm or longer, as desired.

As shown in FIG. 2B, cleaning element 200 includes a bend 232 adjacent the junction of base portion 204 and projecting portion 208. Projecting portion 208 has a width 236 which typically must be narrower than the exposed length of the steel rod 108 in recess 112 in the sole 116 of a particular ski boot 100, 104 such that the cleaning element can be inserted between the steel rod and the sole of the ski boot and within the recess 112 rearward of the rod. In other words, projecting portion 208 has a width somewhat less than the width of recess 112, as measured between sidewalls 120. In one implementation, width 236 of cleaning element 200 is between 6 mm and 50 mm. In some embodiments, width 236 may be 19 mm and in other embodiments about 25 mm. Generally, width 236 should be less than about 30 mm, i.e., less than 25-31 mm, e.g., from 20-30 mm, such that it will fit into any recess, like recess 112, for interfacing with a binding on a ski on any commercially available ski boot. Although not specifically labeled, the thickness of projecting portion 208 of cleaning element 200, as shown on the left-hand side of FIG. 2A, may, in one embodiment, be between 1.5 mm and 12 mm. In other embodiments, cleaning element 200 may have a thickness of 3 mm or a thickness just thin enough to slip easily between the steel rod and the sole of the ski boot, i.e., a thickness less than a rod opening height or other distance between a binding securing rod and a ski boot sole (see, e.g., FIGS. 4A-B). Further, although the thickness of the projecting portion 208 of cleaning element 200 is illustrated as having a substantially uniform thickness with base portion 204, these thicknesses may vary. For example, the thickness of projecting portion 208 may be thinner or wider, either partially or in its entirety, than the thickness of non-projecting base portion 204.

Cleaning element 200 may have a unitary construction or may be made from multiple sections secured together by known techniques. In one embodiment, base portion 204 and projecting portion 208 are made from a single piece of material, and in another embodiment the base and projecting portions are made from separate pieces of material secured together adjacent bend 232. Cleaning element 200, or at a minimum projecting portion 208, is, in one embodiment, made from relatively rigid materials so that it will flex only a limited amount (e.g., no more than 5 degrees of bend from its original shape), if at all, during use. Generally, cleaning element 200 should have a stiffness sufficient to maintain its shape and angle of elevation from the ski during use to the extent necessary to enable it to perform its function and to remain usable. Suitable materials for cleaning element 200 include relatively rigid plastics, metals, wood, carbon fiber composites, fiberglass-epoxy composites, combinations of the foregoing, and other materials that preferably, although not necessarily, are relatively light yet rigid. Base portion 204 and projecting portion 208 may, in one embodiment, be made from planar materials, and in other embodiments may be shaped or made from non-planar materials. Various alternative implementations will be readily apparent to those of ordinary skill in the recreational equipment arts after reading this disclosure in its entirety. For example, a cleaning element made in accordance with the teachings of the present disclosure may, in alternative embodiments, include a projecting portion comprising a thin but rigid brush attached to a projecting and/or base portion, which may comprise a rigid, optionally toothpick-sized, wire, although such a brush could additionally or alternatively be attached to a base portion like base portion 204 and/or a projecting portion like projecting portion 208. Further, although various embodiments disclosed herein are directed to providing a cleaning element for use with Nordic ski boots, such a cleaning element could additionally or alternatively be designed and/or used for cleaning other types of ski boots or other equipment.

Figure 2C:
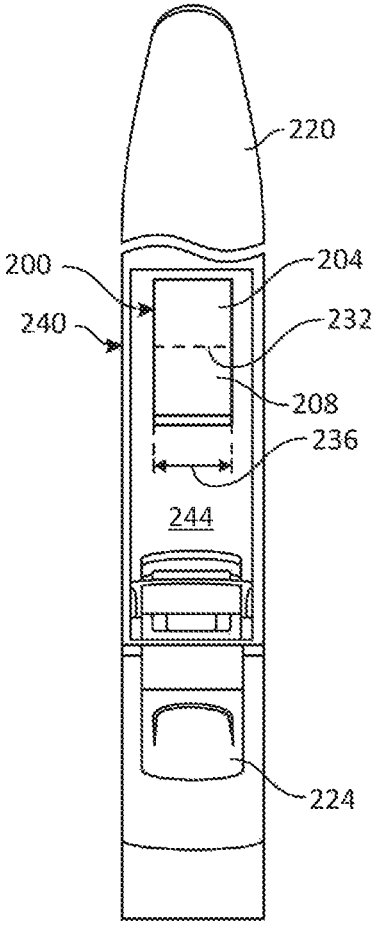

Cleaning element 200 may be disposed on, or formed integrally with, a surface 220. In one preferred embodiment, surface 220 will be the top surface of a ski 240 and cleaning element 200 may be positioned slightly forward of a binding 224 (FIGS. 2A-B), e.g., 25-305 mm or one-half to two boot lengths in front of the binding, so that projecting portion 208 projects rearwardly toward the binding, as shown in FIGS. 2A-B. In other implementations, not shown, cleaning element 200 may be secured to top surface 220 of ski 240 so that projecting portion 208 projects forwardly away from the binding 224. The long axis of cleaning element 200 is illustrated in FIG. 2B extending parallel to the long axis of ski 240. In other implementations, cleaning element 200 may be positioned so that its long axis extends at an angle (not parallel) to the long axis of the ski. As shown in FIG. 2C, in some embodiments, cleaning element 200 may be disposed on, or made integral with, a plate 244 attached to top surface 220 of ski 240. Plate 244 may, in one example, also be positioned between binding 224 and top surface 220 of ski 240, or may, in another example merely be positioned in front of the binding. In yet another example, plate 244 may be attached to binding 224, either as an integral assembly or by using known fasteners or fastening techniques. In the latter example, it may be desirable, although not essential, to attach the portion of plate 244 extending in front of binding 224 to top surface 220 of ski 240 by known techniques, e.g., using an adhesive or mechanical fasteners. Cleaning element 200 may also be secured to a fixed surface 220 formed on a floor, platform, or any other surface skiers may be near when attaching their skis.

Figure 5:
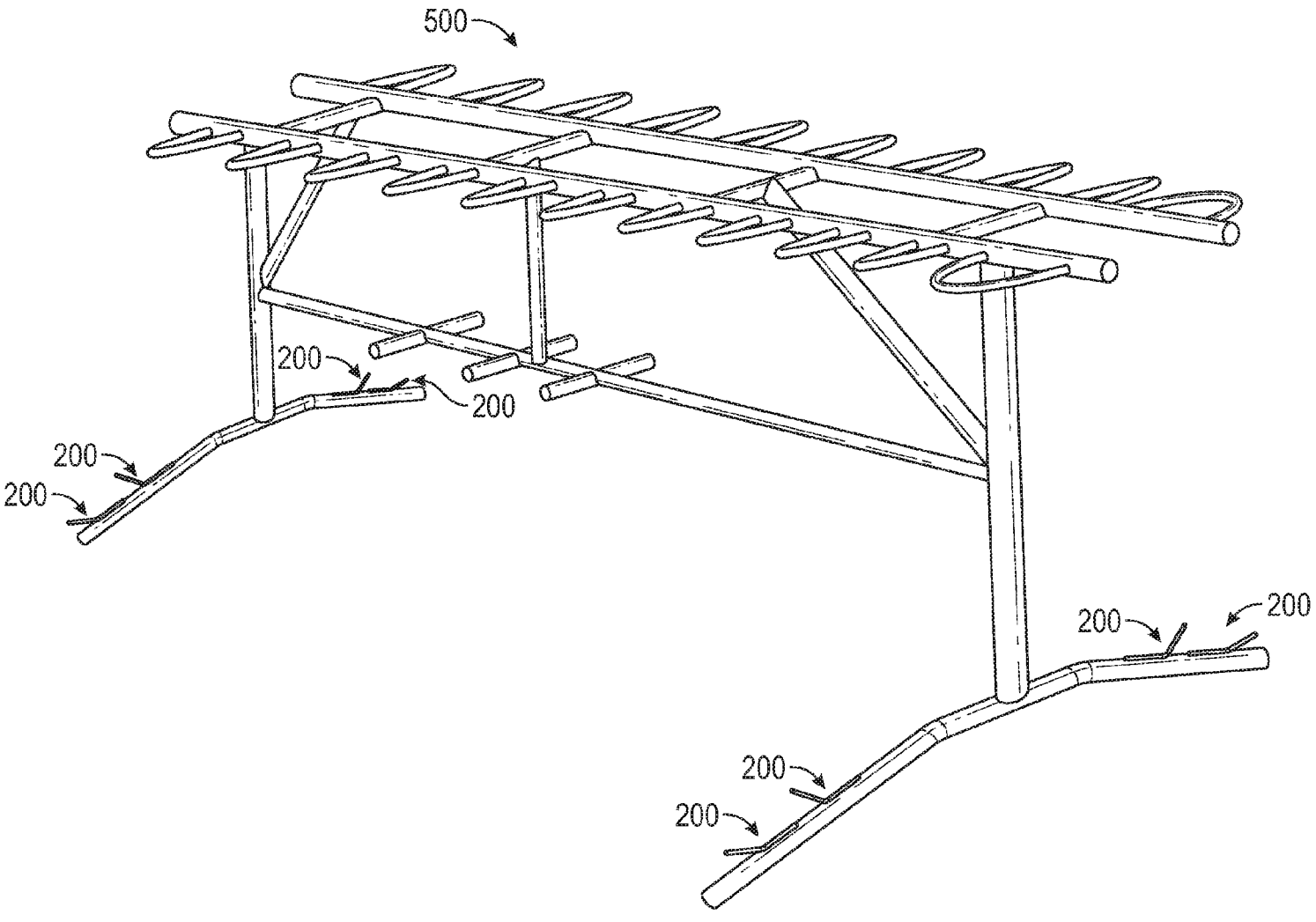
FIG. 5 illustrates various further embodiments of an apparatus made in accordance with the teachings of the present invention.

FIG. 5 illustrates how one or more cleaning elements 200 can be attached to one example of the fixed surface discussed above, namely various types of ski racks, such as ski rack 500. In such embodiments, one or more cleaning elements 200 may be formed integrally with one or more components of a ski rack; in other such embodiments, one or more cleaning elements may be secured, either temporarily or permanently, to a surface, whether a flat surface, a rounded surface, or other surface, of a ski rack. As shown in FIG. 5, in some embodiments, two or more cleaning elements 200 may be installed in close proximity to one another such that a user can use them sequentially without having to reposition their other foot. As shown in FIG. 5, cleaning elements installed near each other may be configured to project at different angles relative to a level ground plane such that one can be used to easily perform the cleaning operation of recess 112 of ski boot 100, as illustrated in FIG. 4A, while the other can be used to easily perform the cleaning operation of the region above rod 108 of the ski boot, as shown in FIG. 4B. In some embodiments, where two cleaning elements 200 are installed in close proximity, one of the cleaning elements may project at a 35 to 90 degree angle relative to a level ground plane while the other may project at a −45 to 35 degree angle relative to the same level ground plane, although other angles could be used. In some embodiments, more than two cleaning elements 200 may be installed in close proximity to one another and may be configured to project at different angles relative to each other and/or to a level ground plane, as desired. As shown in FIG. 5, four sets of cleaning elements can be installed in close proximity to one another on a single ski rack 500, creating four cleaning stations that can be used simultaneously, each cleaning station in this case providing access to two cleaning elements that project at different angles relative to each other and to a level ground plane. In some embodiments, cleaning elements 200 may be attached to a surface with a hinge such that the cleaning elements can be folded flat against or be received within the surface from which they project when not in use.

Figure 3:
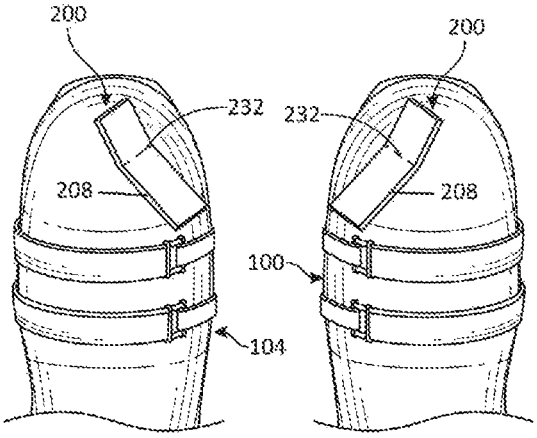
FIG. 3 illustrates another embodiment of an apparatus made in accordance with the teachings of the present invention, including two cleaner elements disposed on opposite ski boot upper surfaces.

In another alternative embodiment, as shown in FIG. 3, cleaning element 200 may be disposed on an upper surface of a left ski boot 104 or right ski boot 100. As shown, cleaning element 200 may be disposed such that the projecting portion 208 faces at least partially towards the opposite foot. Although cleaning element 200 is shown with the projecting portions 208 being different in length to the base portions, the length of the projecting portion may be shorter than, longer than, or approximately equal to the length of the base portion. In some embodiments, it may be preferable to install cleaning element 200 on boots 100, 104 such that no portion extends beyond the outer bounds of the boots when viewed from the top; however, in other embodiments, the cleaning element may extend partially beyond those bounds. As discussed briefly above, it may be desirable in some cases to attach cleaning element 200 to a ski pole (not shown).

As noted above, cleaning element 200 may be formed as an integral structure with the surface 220 on which it is mounted. In other embodiments, the cleaning element may be secured to surface 220 using methods appropriate to the composition of the surface. Thus, adhesives, mechanical fasteners, flexible closures (e.g., hook and loop), stitching and almost any other securing means may be used to secure cleaning element 200, again, with the most appropriate securing means being selected as a function of the composition and other characteristics of surface 220 and perhaps structure beneath the surface.

In use, a user may insert projecting portion 208 into the recess 112 between rod 108 and adjacent portions of sole 116 of one or more ski boot 100, 104 and/or within recess 112 rearward of the rod, in order to clear out snow, ice, dirt and other undesirable materials. In particular, a user may align their ski boot 100 with projecting portion 208 so that the projecting portion enters recess 112 between rod 108 and adjacent portions of sole 116 and/or recess 112 behind the rod and then push their toe towards and over element 200 such that any snow and other undesirable material is removed before placing their ski boot in the binding of a ski. As shown in FIGS. 4A-B and will be appreciated by those of ordinary skill in the art after reading this disclosure in its entirety, element 200 may be used in different ways depending on angle 216 (FIG. 2A) and the orientation of the element relative to the orientation of a user's boot.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A system for dislodging material trapped in the binding receiving channel of Nordic ski boots, said channel having a width and including a binding securing rod in a front portion defining a rod opening with a height between the rod and boot sole, the system comprising a cleaning element including a base portion configured to be mounted to a surface, and a projecting portion projecting from said base portion, wherein:

said projecting portion is configured and dimensioned to project at a fixed angle from the surface when said base portion is mounted thereon;

said projecting portion has a width less than the binding receiving channel width as to be insertable into and freely moveable through said channel for dislodging of material trapped therein; and said projecting portion has a thickness less than the rod opening height so as to be insertable therethrough for dislodging material trapped in the rod opening.

2. The system of claim 1, wherein said projecting portion of the cleaning element has a substantially uniform thickness less than said rod opening height extending from the base portion to its projecting end.

3. The system of claim 1, further comprising at least one Nordic ski with a rod receiving binding mounted thereon, wherein said cleaning element is mounted on an upper surface of the ski forward of said binding with said projecting portion projecting rearward toward said binding.

4. The system of claim 3, wherein said cleaning element is mounted between one-half boot length and two boot lengths in front of the binding.

5. The system of claim 1, wherein said angle of the projecting portion is between about twenty-five and about fifty-five degrees.

6. The system of claim 1, wherein said projecting portion has a width of less than about 30 mm.

7. The system of claim 6, wherein said projecting portion has a width of greater than about 20 mm.

8. The system of claim 1, wherein said projecting portion has a thickness of less than about 5 mm.

9. A method for dislodging material trapped in the binding receiving channel of Nordic ski boots, wherein said channel has a width and includes a binding securing rod extending across a front portion of the channel defining a rod opening with a height between the rod and boot sole, said method comprising:

placing the ski boot, while on a wearer's foot, over a cleaning element mounted on a surface;

lowering the boot onto the cleaning element with said cleaning element received in said binding receiving channel; and moving the boot forward at least one time with said cleaning element received in said binding receiving channel to dislodge material trapped in said channel.

10. The method of claim 9, wherein said lowering includes positioning the boot with the cleaning element received through said rod opening in the boot.

11. The method of claim 10, wherein said lowering includes lowering the boot sole at the toe area toward the surface while maintaining the boot sole at an acute angle with respect to said surface.

12. An apparatus for dislodging material trapped in the binding receiving channel of Nordic ski boots, said apparatus comprising an element designed and configured to fixedly project from a surface at an angle, wherein said element is sized and shaped such that it is insertable in a recess in a ski boot having a steel rod for interfacing with a binding on a ski such that said apparatus can extend between the steel rod and at least a portion of a lower surface of the ski boot.

13. The apparatus according to claim 12, wherein said angle is between twenty-five and fifty-five degrees.

14. The apparatus according to claim 12, wherein said element comprises a length of material designed and configured to fixedly project from the surface by at least 25 mm along the length of said length of material.

15. The apparatus according to claim 14, wherein said length of material has a width between 20 mm and 30 mm and a thickness between 1.5 mm and 6.5 mm.

16. The apparatus according to claim 12, wherein said apparatus is integrally formed with the surface.

17. The apparatus according to claim 12, wherein said apparatus includes a mounting surface configured to be mounted to the surface of a ski with said element disposed on the ski surface closer to the front of the ski than a binding location on the ski, and said element projects from the surface of the ski towards the binding location.

18. The apparatus according to claim 12, wherein said apparatus includes a mounting surface configured to be mounted to the surface of a ski boot and said element is configured to project rearward on said ski boot.

19. The apparatus according to claim 12, wherein said apparatus includes mounting means comprising at least one of an adhesive strip, a hook and/or loop strip, and screw holes.

20. The apparatus according to claim 12, wherein said apparatus includes a brush.

* * * * *